United States Patent [19]

Kelsey, Jr. et al.

[11] Patent Number: 4,974,356

[45] Date of Patent: Dec. 4, 1990

[54] HIGH CHAMBER PRESSURE PISTOL

[76] Inventors: Charles C. Kelsey, Jr., 1601 Hollyhurst, Ste. C-21, Houston, Tex. 77056; George L. Reynolds, R.R. #1, Altona, Ill. 61414

[21] Appl. No.: 468,852

[22] Filed: Jan. 23, 1990

[51] Int. Cl.[5] ..... F41A 19/10

[52] U.S. Cl. ..... 42/69.03; 42/70.08

[58] Field of Search ..... 42/69.03, 70.08, 65

[56] References Cited

U.S. PATENT DOCUMENTS 2,899,767 8/1959 Boudreau ..... 42/69.03

4,468,876 9/1984 Ghisoni ..... 42/65

*Primary Examiner*—Charles T. Jordan

*Assistant Examiner*—Richard W. Wendtland

*Attorney, Agent, or Firm*—Robert O. Richardson

[57] ABSTRACT

A high chamber pressure piston having the barrel relatively close vertically to the grip to reduce muzzle flip. The hammer and related components are in the bolt above the barrel, the bolt cover with sights do not move during firing, an ambidextrious bolt hold open and release assembly selectively holds the bolt in rearward position and the trigger mechanism has safety features to prevent misfiring and multiple firing.

8 Claims, 4 Drawing Sheets

HIGH CHAMBER PRESSURE PISTOL

This invention relates to high chamber pressure pistols and more specifically to high chamber pressure pistols that have a peak chamber; pressure common to rifle peak chamber pressures, i.e., 50,000 to 60,000 pounds per square inch.

BACKGROUND OF THE INVENTION

To produce a pistol capable of safely functioning ammunition loaded to rifle pressures it is essential that there be an adequate breech lock mechanism such as that disclosed in copending application SN 07/251,311 for Gun Lockand Gas Operating System filed 9-30-88 by George L. Reynolds and issuing Mar. 20, 1990 as Pat. No. 4,909,129. A 9.5 mm cartridge has been developed and loaded to function at peak chamber pressure of about 55,000 psi. A pistol firing such a cartridge must be manageable by novice shooters and therefore must have design features that permit superior weapon control compared to pistols in current use.

In weapons of moderately high recoil, and which are designed to be fired rapidly with aimed shots, it is desirable to place the centerline of the barrel as low as possible relative to the shooter's hand. This is in order to reduce the overturning moment of the weapon due to recoil. This overturning moment results in what is commonly referred to as "muzzle flip". Greater muzzle flip results in the weapon sights moving farther off the target, and requiring more time for the shooter to bring the sights back onto the target than when the pistol has lesser muzzle flip.

Conventional pistols generate muzzle flip at the time of firing. The farther below the center line of the barrel the weapon is gripped, the greater the amount of muzzle flip. This upward movement is caused by the barrel's tendency to recoil in a linear plane but because of being supported by the shooter's grip below the center line of the barrel, rotation takes place about the gripping point. This causes the muzzle to rise up away from the shooter's line of sight with the target. This problem is magnified when rapid firing is performed as the shooter must reaim the pistol after each firing.

SUMMARY OF PRESENT INVENTION

A primary advantage of the pistol of the present invention is the close location vertically of the grip to the centerline of the barrel while still permitting the bolt a path of rearward travel above the shooter's hand. In the present invention the centerline of the barrel is placed so low that the barrel can serve as the top of the trigger guard. To achieve this the hammer and related hammer components are placed in the bolt assembly rather than in the receiver frame as is done in most pistols in current use. Conventional firing mechanisms of pistols locate at least part of the firing mechanism in the frame of the weapon in the area which is surrounded by the shooter's hand. The centerline of the barrel must be higher relative to the shooter's hand than is ideal because of firing mechanism parts in the weapon frame around the grip.

The pistol of the present invention, by placing the firing mechanism lock works in the bolt, results in space being made available in the upper grip frame area to employ an ambidextrous bolt catch. The bolt catch holds the bolt open after the last round of the magazine is fired. An ambidextrous bolt catch is very desirable, although no current pistols are so equipped.

Placing the hammer and related hammer components in the bolt assembly of the present pistol has several major advantages over pistols in current use. It reduces muzzle flip by locating the longitudinal centerline of the barrel closer to the grip. The size of the grip circumference is reduced by removing the hammer spring and hammer spring strut from the space in the receiver framebutt rearward of the magazine well. This reduced circumference enables shooters with small hands greater weapon control. The grip of the weapon can be designed for optimum fit. This is particularly beneficial for women shooters who typically have smaller hands.

Placing the hammer and related hammer firing mechanism components in the bolt assembly above the grip frame makes possible an optimum more vertical angle to the magazine positioning in the receiver frame while also providing latitude for an angled gripping surface. It also improves the cartridge feed angle into the barrel chamber while reducing friction of the follower and cartridges with inner magazine surfaces. Because the magazine feed lips are located farther rearward in the receiver frame, a longer barrel may be provided for the same overall length.

The present pistol has an internal bolt and an external bolt cover which provides an accessible means by which the pistol may be manually charged and cleared. Although the bolt cover may be manually movable in charging and clearing, the bolt cover remains forward and stationary during the firing cycle. This bolt cover provides a surface upon which the shooter may rest the pistol using the two handed firing technique. By supporting the pistol above the longitudinal centerline of the barrel and ahead of the breech end, the shooter improves his ability to steady the pistol during rapid-fire engagement of multiple targets. The bolt cover to which the rear sight is attached, by remaining stationary during the firing cycle, provides the shooter with an enhanced sight picture.

The pistol illustrating the present invention is designed for double action firing. In double action firing it is desirable for the trigger pull to provide a moderated continuous pull through the entire travel of the trigger while the firing mechanism spring is being compressed. After the firing mechanism spring is compressed, while pulling the double action trigger, it is then desirable for the trigger pull force to significantly increase just before the firing mechanism is released of "let-off". This permits the shooter to cock the firing mechanism in a manner typical to double action revolvers, and then to aim and squeeze the trigger for accurate individual shot placement as typical to single action firing. When rapid firing is required, the trigger is quickly pulled through to fire the shots without regard to the change in pull at the final stage. This pistol provides the feature of increased trigger pull just before let-off of the firing mechanism. This is accomplished by the hammer link contacting and riding up the hammer link ramp in the feed cover at the final stage of the trigger pull. The increased force results from the friction of the hammer link with the trigger as the hammer link is raised out of engagement with the trigger.

The pistol illustrating the invention, used in conjunction with the gas operating system and breech lock arrangement for which the earlier referred to patent application was made, provides the means for insuring the breech is locked at the time of firing. When the trigger is pulled, the top of the hammer is pulled forward, which also pulls the hammer strut forward. The front of the hammer strut rests in the hammer strut plunger, which pushes on the hammer/actuator spring in the rear of the actuator. In order for the hammer strut to be able to move forward, the aCtuator must be fully forward. The actuator directly operates the lock, and the actuator cannot move forward without locking the breach. However, the actuator must be fully forward in order to fire the weapon. The trigger and firing mechanism of the present invention positively insures that the weapon is fully locked at the time of firing. Since the above mentioned gas operating system contains the novel actuator, then the safety feature in the current invention involving the same actuator in conjunction with the present trigger and firing mechanism, is believed to be a patentable improvement over existing pistols. The significance of the feature which insures that the weapon breech is locked at the time of firing is that if the breech is not locked, especially in a powerful weapon which operates with very high chamber pressures, the weapon will explode upon firing, potentially inflicting injury on the shooter.

The pistol illustrating the present invention also contains an internal safety mechanism which prevents the firing pin from impacting the primer until the trigger is pulled for firing, and it then prevents the firing pin from impacting the primer until after the trigger is fully released and then pulled again. The importance of this safety device is that it positively prevents the weapon from accidentally firing if the weapon is dropped a long distance onto a hard surface while in such an orientation which would impart adequate firing energy to the firing pin.

Another safety feature of this pistol operates when the trigger is pulled in the act of firing. When the trigger is pulled, the firing pin stop is raised up under the firing pin lug by light spring pressure so it can move, during recoil of the bolt, into a position where it will arrest the firing pin when the firing pin comes forward, riding in the bolt when the mechanism functions in firing to place a fresh round in the chamber. The significance of this feature is that it positively prevents the firing pin from impacting the primer until the trigger is deliberately released and then pulled again.

DETAILED DESCRIPTION OF PREFERRED EMBODIMENT

Figures 1, 7:
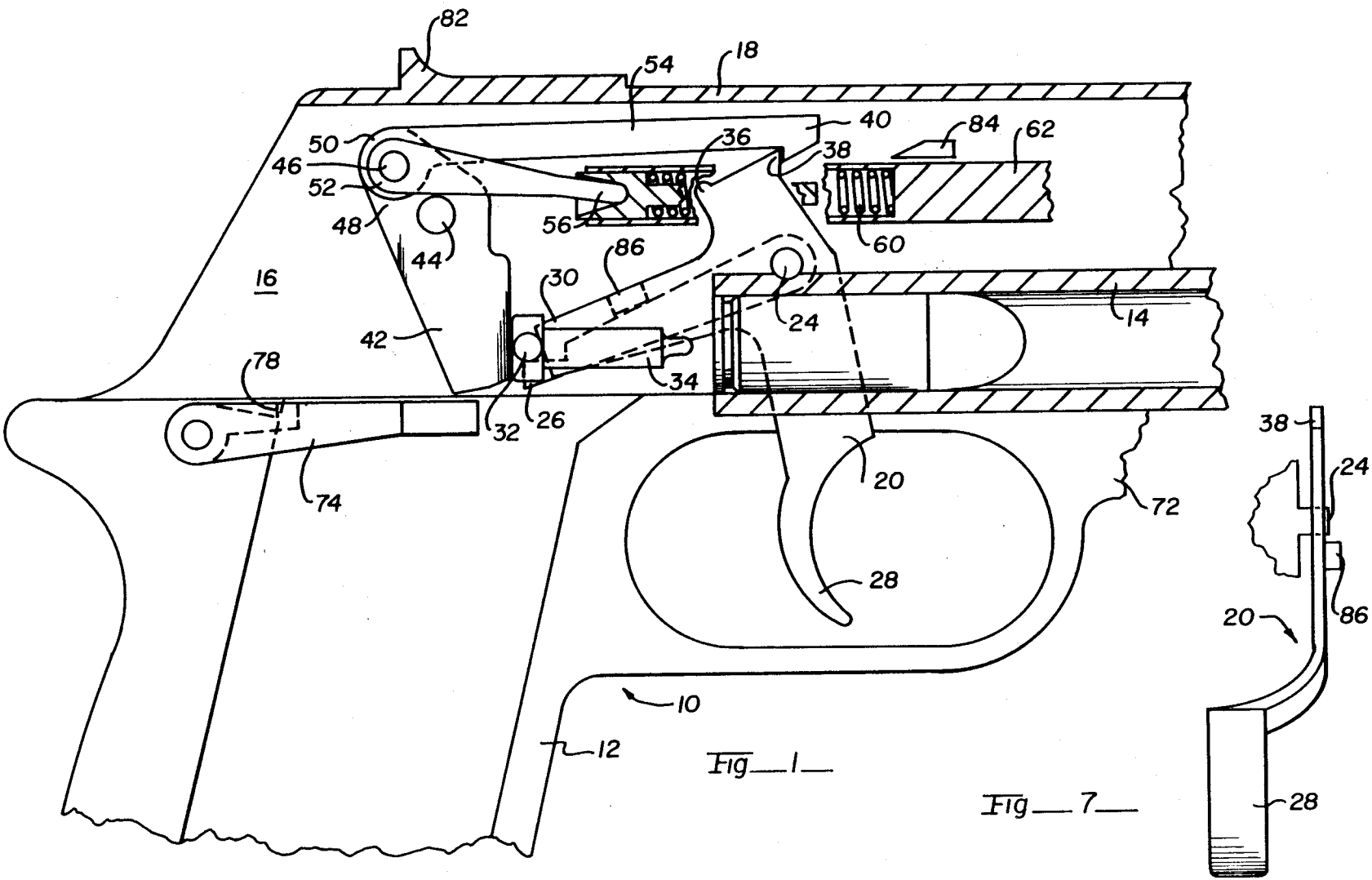
FIG. 1 is a partial sectionalside view of a pistol showing its inventive features. The pistol is in battery position with the bolt closed, a round is in the chamber and the hammer link is engaged with the upper portion of the trigger.
FIG. 7 is a front view of the trigger structure.

Reference is made to FIG. 1 which shows a pistol 10 having a hand grip 12, barrel 14, bolt 16, bolt cover 18, trigger 20, rear sight 82 and various internal mechanisms to be described hereinafter. Trigger 20 is pivotally mounted by pivot 24 to bolt cover 18, along with firing pin stop 26. Above pivot 24 the trigger has a lobe 36 and a hammer link engaging projection 38. Trigger 20 has a finger engaging end 28 and a rearward extending safety projection 30, which engages firing pin lug 32 on firing pin 34 to prevent the firing pin from moving forward and striking the primer in the cartridge in the event the locked weapon is dropped on its muzzle or subjected to strong mechanical shock. The rear of the firing pin stop 26 is positioned below the firing pin lug 52 in FIG. 1 but is spring urged (spring not shown) into the path of firing pin movement (see FIG. 3 ) after a trigger pull has fired a first cartridge. This causes the pistol to operate in a single shot per single squeeze mode even when the shooter is slow in releasing the trigger.

Figure 2:
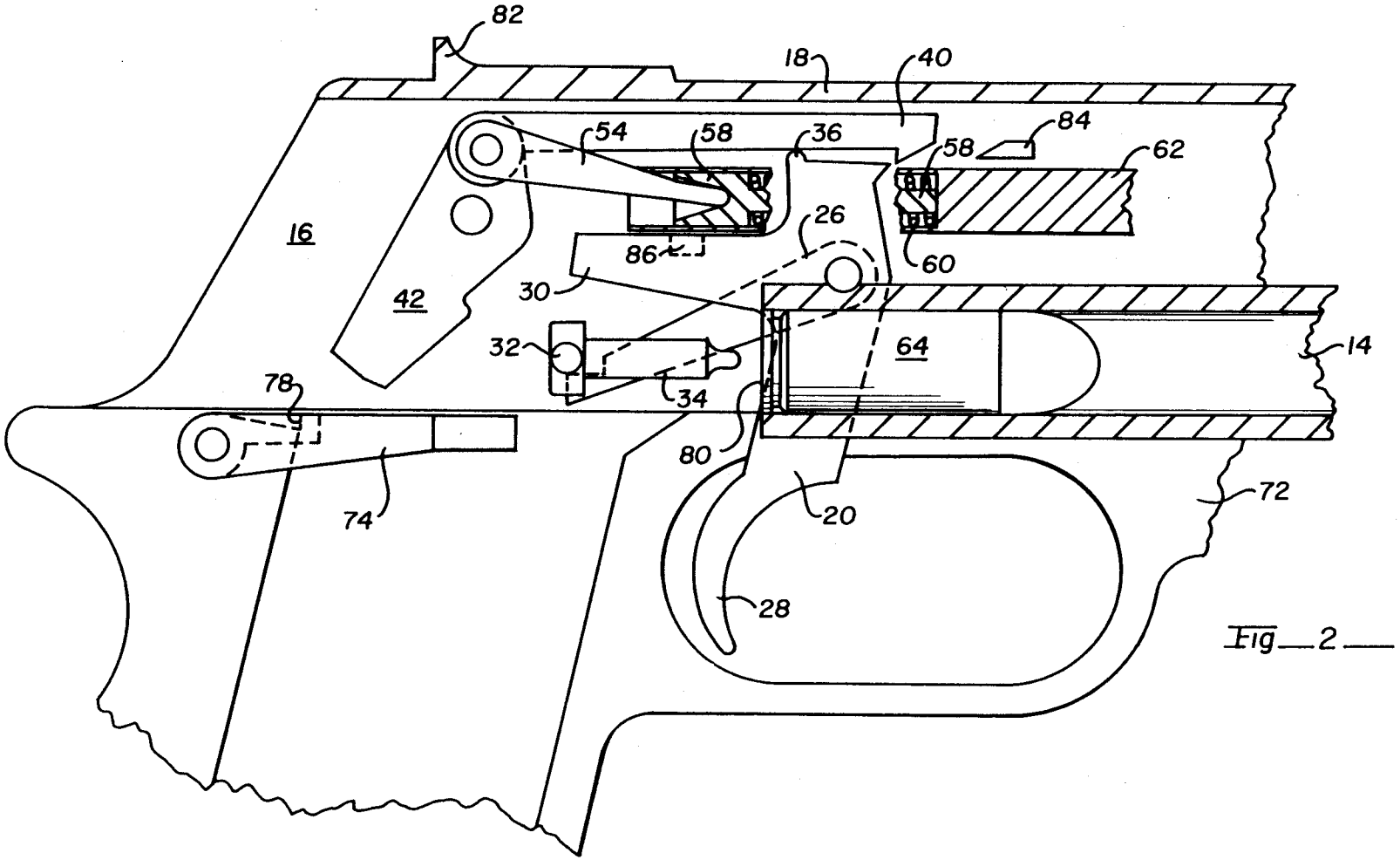
FIG. 2 is a similar view showing the pistol prior to the instant of firing. The trigger has been squeezed and the hammer link is in the process of disengagement with the upper part of the trigger.

As trigger 28 is depressed it moves hammer link 40 to the right and, as shown in FIG. 2, lobe 36 raises hammer link 40, to free it from the influence of trigger 20. Forward movement of hammer link 40 rotates hammer 42 clockwise from its position in FIG. 2. As shown in FIG. 2, hammer 42 pivots at 44 to bolt 16, striking the firing pin 34, firing the weapon. Firing the weapon causes the actuator 62 to be driven rearwardly, unlocking the weapon and compressing the hammer/actuator spring 60 from the front.

There is an internal safety feature which prevents the pistol from firing when it is not fully locked. Pivotally connected at 46 to the upper end 48 of hammer 42 are ends 50 of hammer link 40 and 52 of hammer strut 54. As the hammer 42 presses the hammer strut 54 forwardly, end 56 of hammer strut 54 pushes hammer strut plunger 58 against hammer/actuator spring 60. This urges actuator 62 fully forward into its locked position before firing or the hammer strut 54 will be prevented from moving forward, thus preventing firing.

When trigger 20 is pulled, the safety projection 30 on the trigger is rotated out of the path of the firing pin lug 32 on the firing pin 34. The safety projection 30 in this position no longer prevents forward movement of the firing pin lug 32, so that when the hammer 42 rotates for firing, the hammer can strike the rear of the firing pin 34, and the firing pin can strike the primer of cartridge 64.

The firing pin stop 26 is pressed by slight spring pressure, from a spring not shown, against the bottom of the firing pin lug 32. This spring pressure is not great enough to impede firing but is adequate to lift the firing pin stop 26 upward from its position in FIG. 3 to that shown in FIG. 4. This happens when bolt 16 carries the firing pin 34 rearward due to the action of the power system when the weapon fires. In actual practice, the angled surface of the firing pin stop 26 which contacts the firing pin lug 32 will be fabricated so the surface is parallel to the travel of the firing pin lug 32 so the firing pin stop 26 will not bounce downward when the hammer 42 strikes the firing pin 34.

Figure 3:
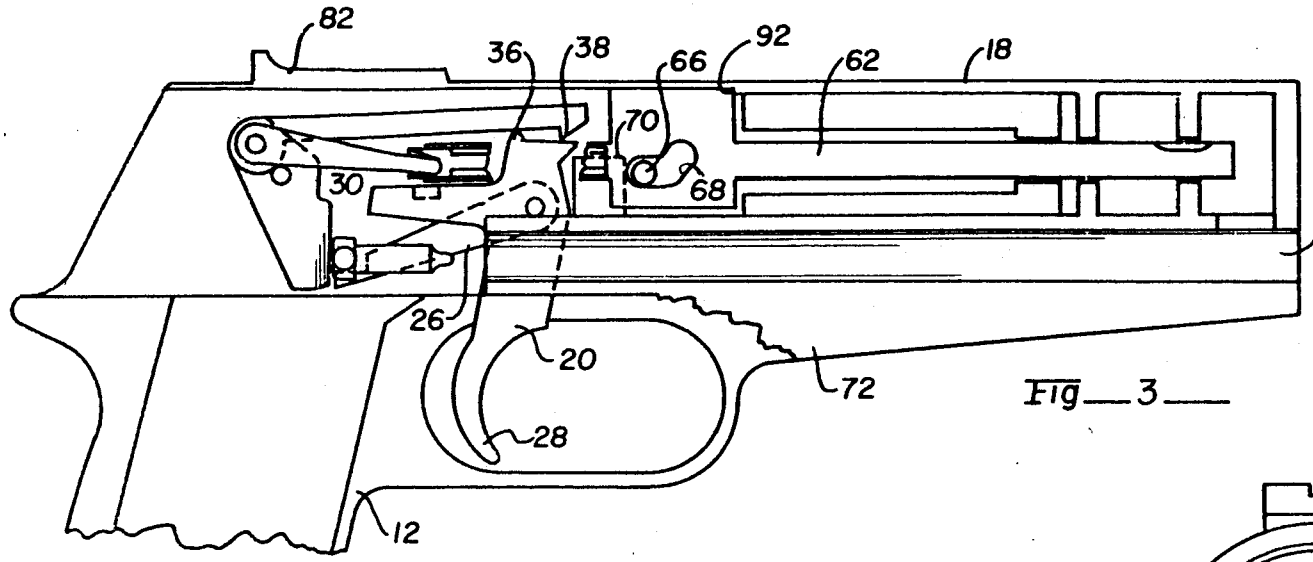
FIG. 3 shows the pistol in battery position at the instant of firing wherein the hammer has rotated to strike the firing pin. This pistol uses the Gun Lock Gas Operating System as set forth in George L. Reynolds co-pending application Ser. No. 07/251,311 filed 9-30-88.
Figure 5:
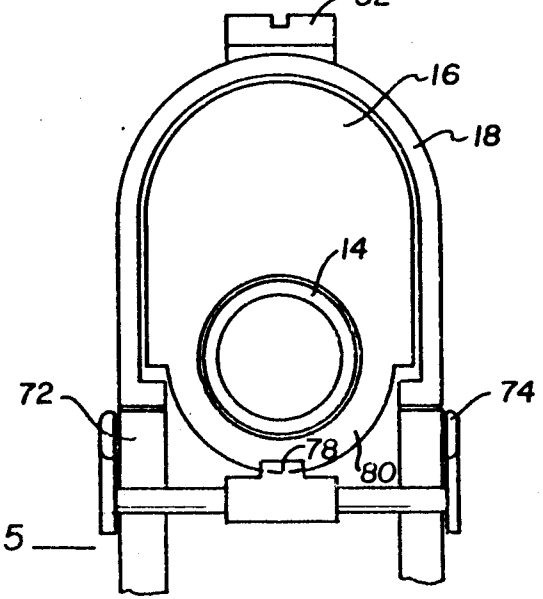
FIG. 5 is a breech or rear end view showing the ambidextrous bolt catch used on the pistol.
Figure 4:
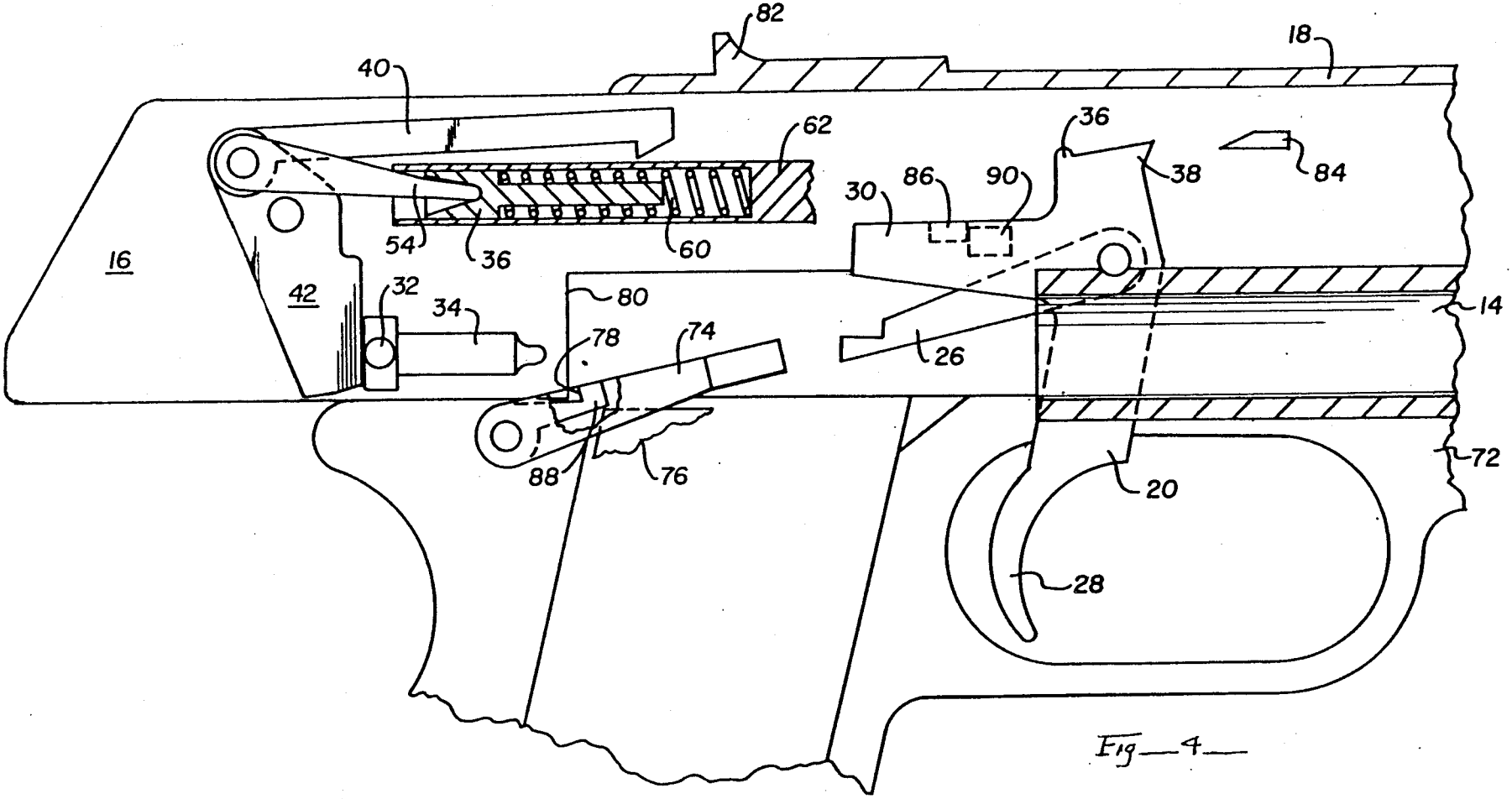
FIG. 4 shows a similar view of the pistol mechanism in recoil position wherein the actuator has moved rearwardly, causing the hammer spring to be compressed in preparation for locking prior to firing the next round.

As the trigger 20 reaches its fully pulled position, as shown in FIGS. 2, 3 and 4, the lobe 36 at the top of the trigger contacts the hammer link 40, forcing the hammer link out of engagement with the trigger. This permits the hammer spring 60 to rotate the hammer 42 counterclockwise to strike the firing pin 34 and thus fire the pistol. The action of lobe 36 on trigger 20 contacting hammer link 40 causes an abrupt increase in trigger pull. This is a desirable feature in that it permits the shooter to make deliberately aimed shots, similar to conventional single action firing, or the shooter can pull the trigger rapidly through its full travel, firing the weapon as in conventional double action firing. This system permits the weapon to be carried fully loaded and ready to fire in a manner as safe as a double action revolver without the need for a deliberately operated safety. At the same time, this firing mechanism permits the weapon to be aimed and fired as deliberately as other weapons which either must be cocked or the safety be deliberately set in its "fire" position before the weapon can be fired.

FIG. 3 shows the firing mechanism of the present invention in combination with the gun lock and gas operating system of copending application Ser. No. 07/251,311 filed 9/30/89 by coinventor George L. Reynolds, now Pat. No. 4,909,129. As explained in that application, gas pressure behind a fired bullet causes actuator 62 to retract. This causes locking member 66 to rise up slope surface 68 to free it from in front of the locking lug 70 on barrel 14 so that the bolt 16 may retract rearwardly to the position shown in FIG. 4. Reference is made to that copending application for a more detailed explanation.

Figure 6:
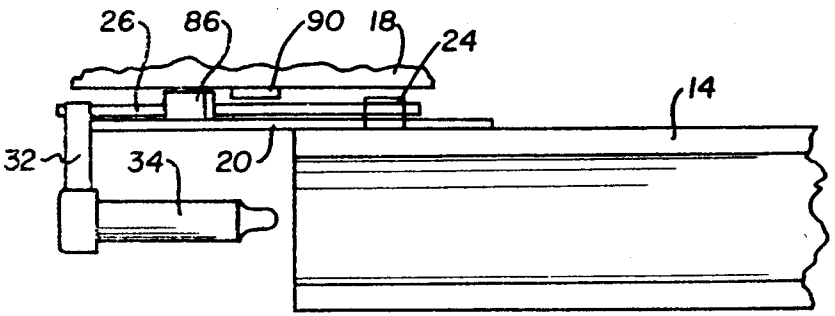
FIG. 6 is a top view of the firing pin and its actuation structure.

As previously stated the bolt cover 18 remains forward during the firing operation. When the trigger 20 is squeezed the trigger lug 86 rises into the path of the internal projection 90 of the bolt cover 18 to prevent it moving back. Projection 90 is shown in FIGS. 4 and 6. The bolt cover 18 is held forward by actuator 62 engaging inner surface 92 on the bolt cover until the actuator moves rearwardly in firing or the bolt cover 18 is manually pulled back for charging or clearing the weapon.

In FIG. 4 the weapon has been fired and the bolt is rearward in recoil. The trigger 20 is still pulled, in the act of firing. The firing pin stop 26 is rotated upwardly so that when the bolt 16 completes its recoil, and the bolt returns to battery, the firing pin stop 26 will block complete forward movement of the firing pin lug 32 and firing pin 34. This position prevents the weapon from firing a second round until the trigger is released and pulled again. At the completion of each firing cycle the trigger must be fully released and then pulled again in order to cock the hammer and fire the weapon again. This is the same principle that is employed in inherently safe double action revolver systems. When the trigger is released and returned to its position shown in FIG. 1, the lug 86 on the trigger engages the firing pin stop and moves it down, out of engagement with firing pin lug 32, so it no longer blocks the firing pin and permits the weapon to be fired. However, with the trigger released to its FIG. 1 position, safety projection 30 blocks movement of firing pin lug 32 until the trigger 20 is again squeezed.

The frame 72 of the weapon contains none of the firing mechanism. This results in a smaller hand grip 12 and an ideally configured ambidextrous bolt catch 74 for locking the bolt 16 to the rear after the last round in the magazine has been fired. In FIGS. 1 and 2 the bolt catch 74 is shown depressed. In FIG. 4 the bolt catch contacting member 88 is raised by the magazine follower 76 so that the latching surface 78 of the bolt catch engages the bolt face 80 of bolt 16.

Neither the bolt cover 18 nor any parts projecting from the sides of the weapon travel with the bolt 16 during the firing cycle. Thus the weapon may be rested on or against any available support, permitting the supported weapon to be fired without any interference from the support.

Since the sights 82 are on the bolt cover 18 which does not move when the weapon is fired, the sights do not "jump" relative to the rest of the recoiling weapon. This provides a more rapid recovery of the sight picture by the shooter during rapid firing.

The function of ramp 84 within bolt cover 18 is to lift the hammer link 40 out of engagement with the trigger 20 when chambering a round or clearing a round from the chamber. It has no function during firing.

Having described the preferred embodiment wherein the present invention is used, it is to be understood that variations, improvements and modifications may be made without departing from the spirit of the invention, and that such deviations and alterations are to be considered as part of the present invention as set forth in the following claims.

What we claim is:

1. A high chamber pressure weapon comprising:

a frame having a hand grip, barrel and bolt cover, a bolt movable rearwardly, a trigger mounted above said barrel by a pivotal connection to said frame, a hammer mounted by a pivotal connection to said bolt, said hammer having an upper portion above said pivotal connection and a lower portion below said pivotal connection, a hammer link pivotally connected to said hammer for movement therewith, said trigger having a portion above said pivotal connection engagable with said hammer link, said trigger upon manual pull thereon being operable to become disengaged from said hammer link, said resilient means urging said hammer and said hammer link rearwardly thereby rotating said hammer such that (the) said upper portion of said hammer moves rearwardly and said (the) lower portion of said hammer moves forwardly.

2. A high chamber pressure weapon as in claim 1 wherein said weapon has a magazine containing a plurality of rounds of ammunition including a first and a last round, and wherein said pistol frame has a right and left side, and wherein an ambidextrous bolt latch pivotally mounted on said frame engages and keeps said bolt in rearward recoil position after the last round from the magazine is fired, said latch being pivotally mounted transversely on said frame behind said magazine and below said bolt, said latch having manual release levers on both sides of said pistol frame for releasing said latch from said bolt for forward movement thereof.

3. A high chamber pressure weapon as claimed in claim 1 wherein said trigger portion above said pivotal connection includes a hammer link engaging portion and a lobe which are moved forwardly upon manual pull of said trigger whereby said lobe engages and raises said hammer link and frees said hammer link from said hammer link engaging portion.

4. A high chamber pressure weapon as claimed in claim 1 wherein one end of said resilient means bears against an actuator and another end bears against a connecting means to said upper portion of said hammer above said hammer's pivotal connection to said bolt, whereby when said actuator is in a forward locked position said resilient means serves as a hammer spring and when said hammer is in fired position said resilient means serves as an actuator spring to return said actuator to said forward locked position.

5. A high chamber pressure weapon as claimed in claim 4 wherein said connecting means bears against said actuator for movement thereof when said resilient means has insufficient strength to cause separation therebetween.

6. A high chamber pressure weapon as in claim 1 wherein a firing pin is affixed to said bolt for fore and aft path of movement therein, said trigger having a rearwardly extending safety projection in said fore and aft path when said trigger is in non-fired position and clear of said path when said trigger is squeezed into firing position.

7. A high chamber pressure weapon as in claim 1 wherein a firing pin lug is affixed to said bolt for fore and aft path of movement therein, a firing pin stop pivotally mounted at said trigger pivotal connection and movable into and out of said path, said stop being out of said path at the time of trigger squeeze for firing and into said path when said bolt moves rearwardly on recoil, a projection on said trigger moving said firing pin stop out of said path when said trigger is released from firing position.

8. A high chamber pressure weapon as in claim 1 wherein said bolt cover is restrained from rearward movement during firing by a trigger lug on said trigger which, when said trigger is pulled, moves said lug up into the rearward moving path of an internal projection on said bolt cover, and held forward by an actuator when said trigger is not pulled.

* * * * *